US012303002B1

(12) United States Patent
Doshi

(10) Patent No.: US 12,303,002 B1
(45) Date of Patent: May 20, 2025

(54) JEWELLERY ARTICLE

(71) Applicant: Kunal Doshi, Mumbai (IN)

(72) Inventor: Kunal Doshi, Mumbai (IN)

( * ) Notice: Subject to any disclaimer, the term of this patent is extended or adjusted under 35 U.S.C. 154(b) by 0 days.

(21) Appl. No.: 18/428,144

(22) Filed: Jan. 31, 2024

(51) Int. Cl.
*A44C 5/20* (2006.01)

(52) U.S. Cl.
CPC ..... *A44C 5/2076* (2013.01); *A44C 5/2033* (2013.01); *A44D 2203/00* (2013.01)

(58) Field of Classification Search
CPC ..... A44C 5/2076; A44C 5/2033; A44C 5/105; A44C 5/107; A44C 13/00; A44C 5/2042; A44C 17/02; A44C 25/00; A44C 25/007; A44C 5/18; A44D 2203/00; Y10T 24/32
USPC ..... 63/1.18
See application file for complete search history.

(56) References Cited

U.S. PATENT DOCUMENTS 7,073,232 B1 * 7/2006 Fuhrman ..... A44C 5/2042 24/303
2003/0061689 A1 * 4/2003 Fuhrman ..... A44C 5/2076 24/303
2009/0133229 A1 * 5/2009 Kogen ..... A44C 5/2042 24/303
2010/0257898 A1 * 10/2010 Bonilla ..... A44C 5/2095 63/3.1
2020/0046090 A1 * 2/2020 Gunie ..... A44C 5/2085

* cited by examiner

*Primary Examiner* — Jack W Lavinder
(74) *Attorney, Agent, or Firm* — FORGE IP, PLLC

(57) ABSTRACT

A jewellery article includes first and second locking arrangements and an alignment mechanism. The first locking arrangement is formed by connecting first and second free ends of the jewellery article between a separated condition and a connected condition through magnetically attractive surfaces. The alignment mechanism is formed by engaging a projection on the lateral surface of the first magnetically attractive surface with a recess on the lateral surface of the second magnetically attractive surface thereby facilitating precise alignment of the first and second surfaces. The second locking arrangement is facilitated by a safety catch configured to be moved between catch and release positions such that hook and catch elements are engaged in the catch position thereby inserting the hook element into the catch element to mechanically releasably secure the first and second free ends together in the connected condition of the aligned first and second magnetically attractive surfaces.

11 Claims, 12 Drawing Sheets

JEWELLERY ARTICLE

TECHNICAL FIELD OF INVENTION

The invention relates generally to jewellery article and more particularly to secure two free ends of jewellery article like necklace, bracelets, other chains, textile accessories, accessories and the like.

BACKGROUND OF THE INVENTION

Fine jewellery articles made of gold jewellery, silver jewellery or jewellery containing gemstones are widely used. Current technologies and products in the jewellery industry offer traditional clasp mechanisms, such as lobster clasps, box clasps and the like, to secure jewellery articles. While these clasps serve their purpose, they often require dexterity to fasten and unfasten. Even young people, having a great deal of dexterity, find it difficult to fasten necklaces behind their necks or fasten most bracelets which by their nature, must be fastened with the use of only one hand. This problem is compounded many folds in the case of older people who suffer from even mild cases of arthritis or similar afflictions that limit the use of the hands. Thus, one of the key issues is inconvenience of putting on and securing a jewellery by oneself and many people struggle with clasps or require assistance to wear jewellery.

Additionally, in some jewellery articles instead of clasp, or along with clasp elastic cords or stretch bands are used to secure jewellery articles. The bands or cords in practicality loses their elasticity over time, compromising the fit and security of the article.

Therefore, the jewellery industry has a long felt need to meet that the clasp must be easy to close, it must be properly aligned, it must be secure when closed, and it must be easy for the wearer to open. In addition to those functional requirements, the jewellery article must be commercially benefited by being attractive so that the clasp enhances, rather than detracts, from the overall attractive appearance of the jewellery itself.

The object of the present invention is to provide a jewellery article that is simple to put on, creates a smooth and seamless appearance when worn, and incorporates a hidden locking mechanism. Additionally, the invention aims to offer a durable product with dual functionality, aesthetic appeal, and potential health benefits.

The further object of the invention is to facilitate two free ends of the jewellery article so that the wearer can readily join the free ends of the jewellery article, and to secure so that it does not easily and inadvertently become unattached and risk the potential loss of the jewellery.

SUMMARY OF THE INVENTION

According to an aspect, the present invention provides a jewellery article, comprises a first locking arrangement, an alignment mechanism and a second locking arrangement. The first locking arrangement is formed by connecting a first free end of the jewellery article to a second free end of the jewellery article between a separated condition and a connected condition. The first free end having a first magnetically attractive surface formed by at least one magnet positioned on a lateral surface. The second free end having a second magnetically attractive surface formed by at least one magnet positioned on a lateral surface. The first and second magnetically attractive surfaces magnetically attract to the other in the connected condition when the lateral surfaces of the first and second free ends are parallel to each other. The first and second free ends configured to be moved into the separated condition in response to a pulling force applied thereby breaking the magnetic attraction between the first and second magnetically attractive surfaces.

The alignment mechanism, configured to be formed by engaging a projection defined on the lateral surface of the first magnetically attractive surface with a recess defined on the lateral surface of the second magnetically attractive surface thereby facilitating precise alignment of the first and second magnetically attractive surfaces, said projection configured to be positioned within said recess such that said first and second free ends are aligned thereby preventing twisting of the first and second free ends about a longitudinal axis thereof.

The second locking arrangement is configured to be facilitated by a safety catch. The safety catch is pivotably connected to one of the first or second free ends. The safety catch having an arm member, the arm member having a hook element connected thereto. The safety catch having a catch element being located within the other of the first or second free ends. The arm member configured to be moved between a catch position and a release position such that the hook element and the catch element are engaged in the catch position thereby inserting the hook element into the catch element to mechanically releasably secure the first and second free ends together in the connected condition of the aligned first and second magnetically attractive surfaces.

According to another aspect, the present invention provides the safety catch configured to be positioned perpendicular to the longitudinal axis of the jewellery article.

According to yet another aspect, the present invention provides the first and second free ends having a slot in a bottom surface in the direction perpendicular to the longitudinal axis of the jewellery article to accommodate the arm member.

According to further aspect, the present invention provides the arm member configured to be positioned in the slot and flush with the bottom surface of the first and second free ends.

According to further aspect, the present invention provides one of the first and second free ends has at least an identification mark adapted to facilitate identification of the first and the second free ends to a wearer of the jewellery article.

BRIEF DESCRIPTION OF DRAWINGS

The above and other aspects, features, and advantages of certain exemplary embodiments of the present invention will be more apparent from the following description taken in conjunction with the accompanying drawings in which.

Persons skilled in the art will appreciate that elements in the figures are illustrated for simplicity and clarity and may have not been drawn to scale. For example, the dimensions of some of the elements in the figure may be exaggerated relative to other elements to help to improve understanding of various exemplary embodiments of the present disclosure. Throughout the drawings, it should be noted that like reference numbers are used to depict the same or similar elements, features, and structures.

DETAILED DESCRIPTION OF THE INVENTION

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions are omitted for clarity and conciseness.

The terms and words used in the following description and claims are not limited to the bibliographical meanings but are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

Figure 1:
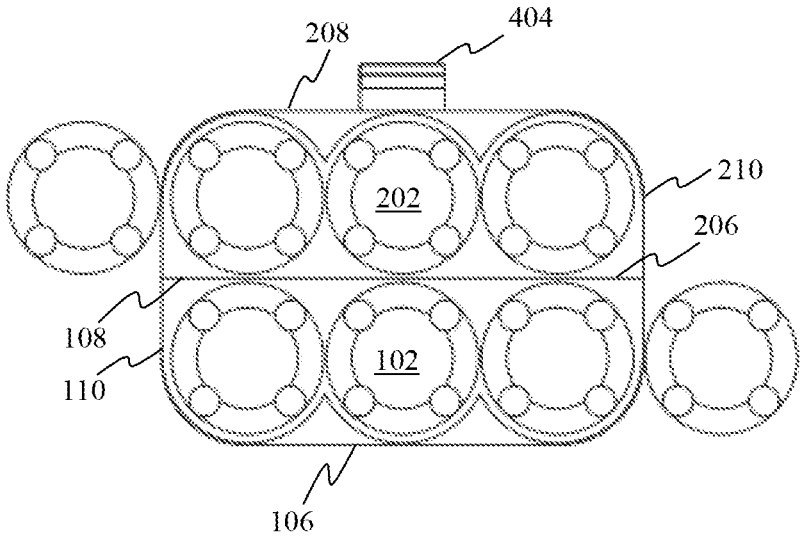
FIG. 1 is a top view of first and second free ends of jewellery article in connected condition.
Figure 2:
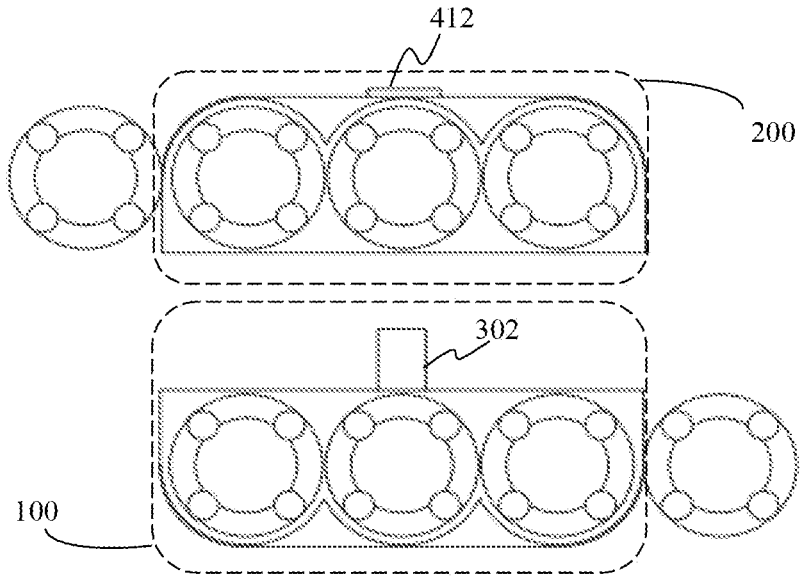
FIG. 2 is a top view of first and second free ends of jewellery article in separated condition.
Figure 3:
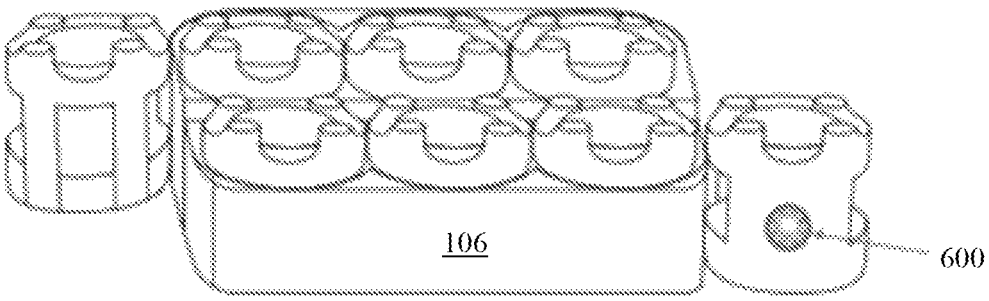
FIG. 3 is an isometric view of FIG. 1.
Figure 4:
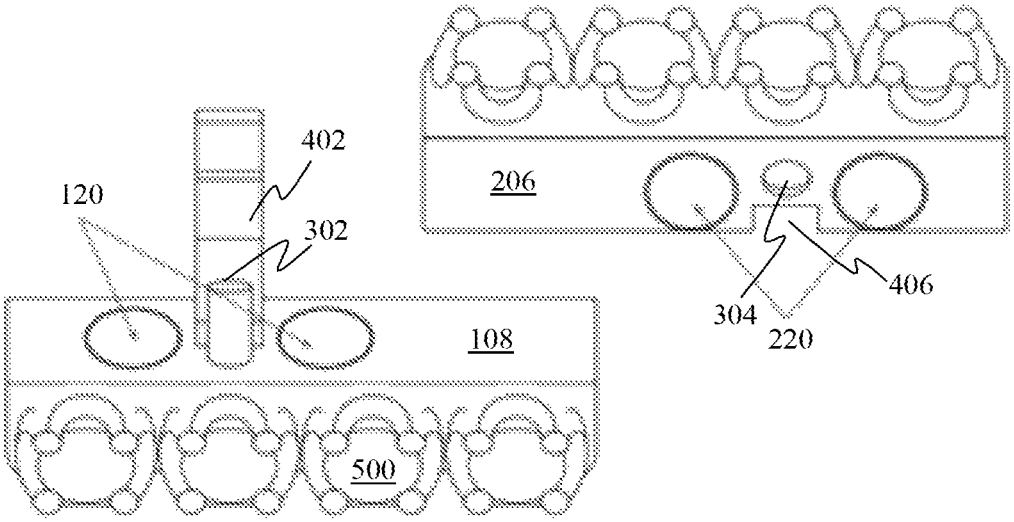
FIG. 4 is an isometric detailed view of FIG. 2.
Figure 5:
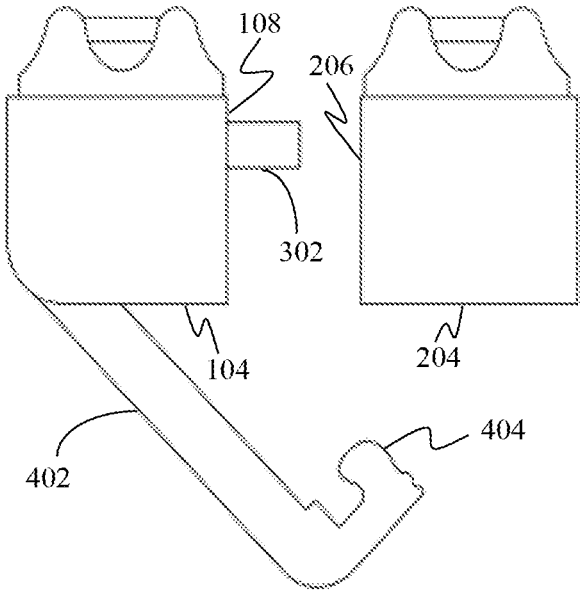
FIG. 5 is a side view of FIG. 2.
Figure 6:
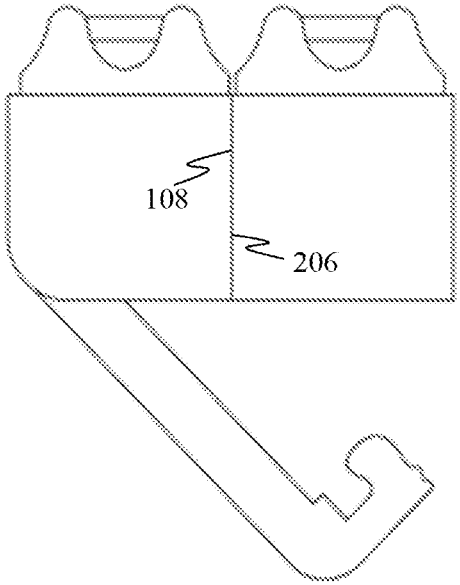
FIG. 6 is a side view as in FIG. 1, but with the safety catch released with its arm in a release position.
Figure 7:
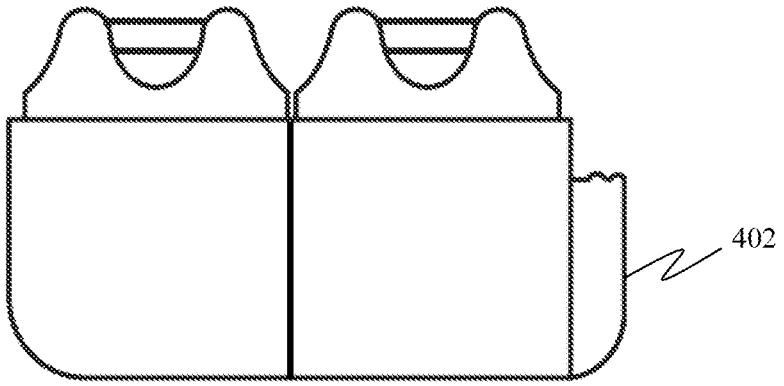
FIG. 7 is a side view of FIG. 1.
Figure 8:
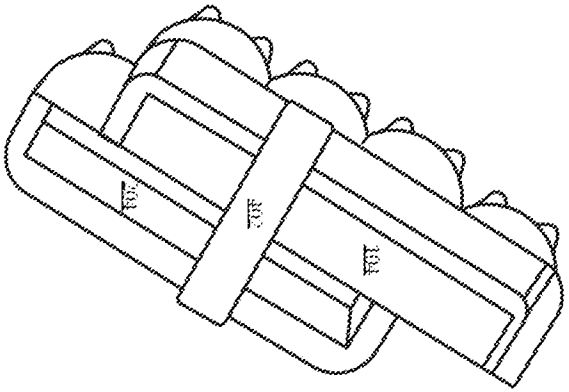
FIG. 8 is a bottom side isometric view.
Figure 9:
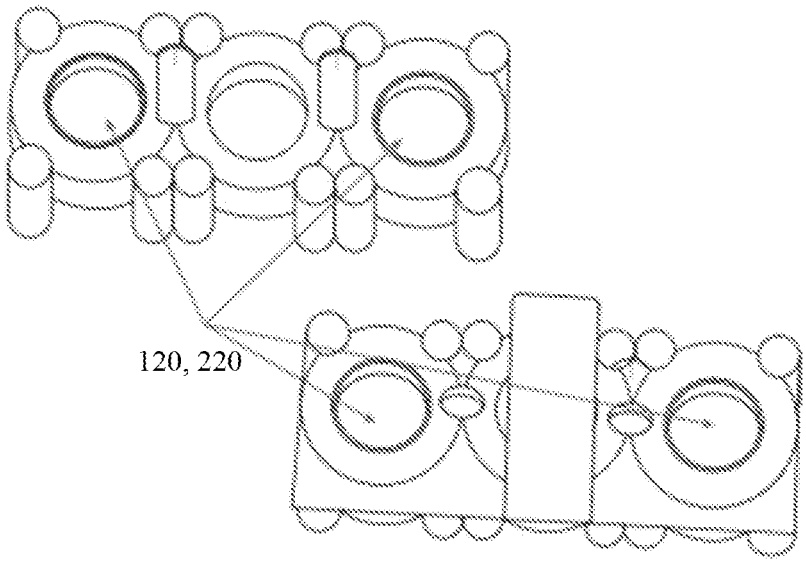
FIG. 9 is top isometric view showing magnetically attractive surfaces on top surface of first and second free ends, according to an embodiment of the invention.
Figure 10:
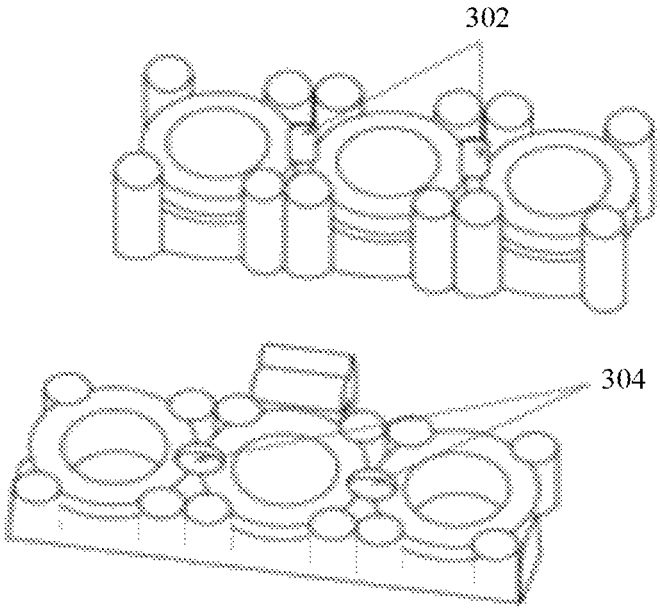
FIG. 10 is a top isometric view showing projection and recess configuration on first top surface and second top surface, according to an embodiment of the invention.
Figure 11:
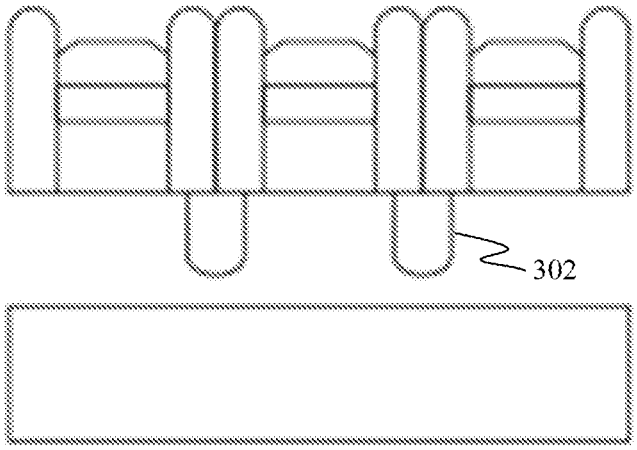
FIG. 11 is a front view showing top-down arrangement of first and second free ends, according to an embodiment of the invention.
Figure 12:
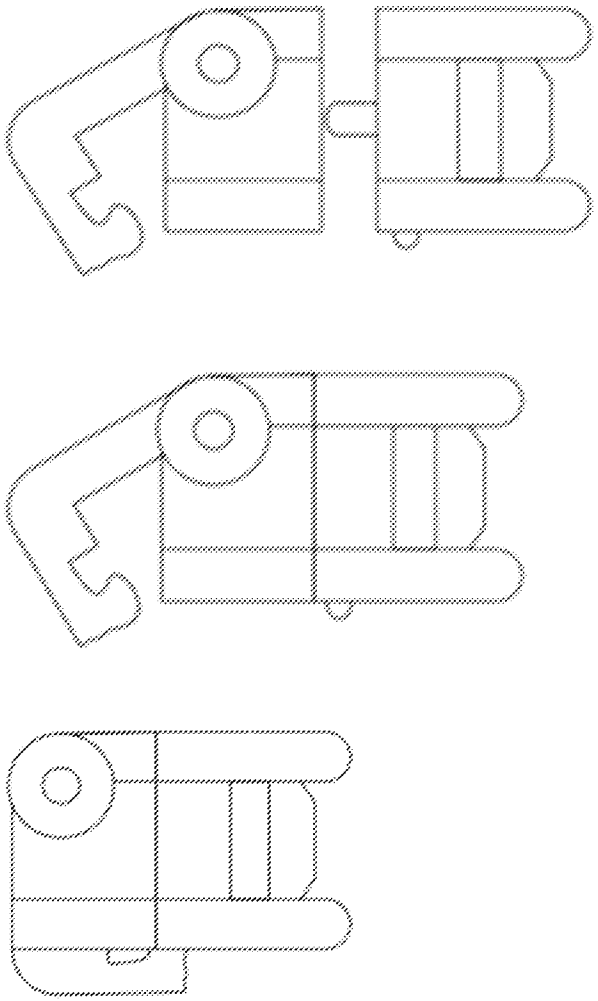
FIG. 12 is a various side views showing top-down arrangement of first and second free ends, according to an embodiment of the invention.

Referring to FIGS. 1 through 12, discussed below, and the various embodiments used to describe the principles of the present disclosure in this patent document are by way of illustration only and should not be construed in any way that would limit the scope of the disclosure. Those skilled in the art will understand that the principles of the present disclosure may be implemented in any suitably arranged jewellery article. The terms used to describe various embodiments are exemplary. It should be understood that these are provided to merely aid the understanding of the description, and that their use and definitions, in no way limit the scope of the invention. Terms first, second, and the like are used to differentiate between objects having the same terminology and are in no way intended to represent a chronological order, unless where explicitly stated otherwise.

FIGS. 1-12 are merely representational and are not drawn to scale. Certain portions thereof may be exaggerated, while others may be minimized. FIGS. 1-12 illustrate various embodiments of the invention that can be understood and appropriately carried out by those of ordinary skill in the art.

In the foregoing detailed description of embodiments of the invention, various features are grouped together in a single embodiment for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus, the following claims are hereby incorporated into the detailed description of embodiments of the invention, with each claim standing on its own as a separate embodiment.

Referring to FIGS. 1-8 shows various views of a jewellery article according to an embodiment of the present invention. The jewellery article comprises a first locking mechanism, an alignment mechanism and a second locking mechanism to secure free ends of the jewellery article. The first locking arrangement configured to be formed by connecting a first free end (100) of the jewellery article to a second free end (200) of the jewellery article between a separated condition and a connected condition. The first free end (100) having a first top surface (102), a first bottom surface (104), a first left side surface (106), a first right side surface (108), and a first end surface (110). The first free end (100) securing a first magnet (120), the first magnet (120) being positioned at and flush with one of the left or right side surface (106, 108) of the first free end (100) and forming a first magnetically attractive surface therein. The first magnetically attractive surface is configured to be perpendicular to the plane of the first top surface (102) and the first bottom surface (104).

The second free end (200) having a second top surface (202), a second bottom surface (204), a second left side surface (206), a second right side surface (208), and a second end surface (210). The second free end (200) securing a second magnet (220), the second magnet (220) being positioned at and flush with the other of left or right side surface (206, 208) of the second free end (200) and forming a second magnetically attractive surface therein. The second magnetically attractive surface is configured to be perpendicular to the plane of the second top surface (202) and the second bottom surface (204), such that the first magnetically attractive surface being opposite polarity of the second magnetically attractive surface. The first and second magnetically attractive surfaces magnetically attract to the other in the connected condition when the side surfaces (108, 206) of the first and second free ends (100, 200) are parallel to each other, the first and second free ends (100, 200) configured to be moved into the separated condition in response to a pulling force applied thereby breaking the magnetic attraction between the first and second magnetically attractive surfaces.

According to an embodiment of the present invention, the first locking mechanism is the primary mechanism for fastening and securing the jewellery article, ensuring the first and the second free ends (100, 200) remains snug on the wrist. In the first locking mechanism, the first and second free ends (100, 200) of jewellery article are held together by magnetic attraction and released from each other by pulling them apart to break the magnetic attraction. Thus, the two free ends are movable between a connected condition and a separated condition.

According to an embodiment of the present invention, the first magnet (120) and the second magnet (220) is preferably made of Neodymium magnetic material such as sintered Neodymium Iron Boron (NdFeB), although it is understood that magnet can be also made of permanent magnetic materials such as, for example. Samarium cobalt, Alnico ceramic, and Ferrite. The Neodymium magnetic material offers the jewellery article reliable strength and longevity, capable of lasting up to 100 years.

The first magnet (120) and the second magnet (220) according to an embodiment of the present invention are made of circular shape, however, it is understood that the said magnets can be of any shape, such as oval, rectangular, and elliptical, for example.

The first magnet (120) and the second magnet (220) each may be cylindrical with a circular cross-section, or may have any other geometric shape needed to best accomplish the first locking mechanism.

According to an embodiment of the present invention, the first and second magnetically attractive surfaces can be formed on the first and second free ends (100, 200) on their lateral surfaces (106, 108, 110, 206, 208, 210).

According to an embodiment of the present invention, the first magnet (120) and the second magnet (220) are formed on the first lateral surface (106, 108, 110) and the second lateral surface (206, 208, 210) by conventional methods such as, but not limited to, soldering and crimping.

According to an embodiment of the present invention, the first magnetically attractive surface can be formed on the first free end (100) on at least one of the first top surface (102), the first bottom surface (104), the first left side surface (106), the first right side surface (108), and the first end surface (110). The second magnetically attractive surface can be formed on the second free end (200) on at least one of the second top surface (202), the second bottom surface (204), the second left side surface (206), the second right side surface (208), and the second end surface (210).

The alignment mechanism according to the presentation is configured to align the magnetically attractive surfaces of the first free end (100) and the second free end (200) precisely such that the article stays perfectly in place. The alignment mechanism comprises a projection (302) defined on the first magnetically attractive surface and a recess (304) defined on the second magnetically attractive surface. The projection (302) being complimentary shaped and arranged to be positioned within said recess (304) such that said first and second free ends (100, 200) are aligned to prevent twisting of the first and second free ends (100, 200) about the longitudinal axis.

In the alignment mechanism, the projection (302) from the first free end (100) serves as a bridge, for connecting and aligning the first and second free ends (100, 200) precisely. The projection (302) ensures the structural integrity of the jewellery article by aligning the magnetically attractive surfaces of the first free end (100) and the second free end (200) correctly.

The second locking arrangement according to the presentation is configured to mechanically releasably secure the first and second free ends (100, 200) together when the aligned magnetically attractive surfaces are in connected condition. The second locking arrangement is facilitated by a safety catch. The safety catch connected to one of the first or the second free ends (100, 200) in one of a pivoted or hinged manner. The safety catch includes an arm member (402) having a hook element (404) movable between a catch position and a release position. A catch element (412) being located within the other of the first or the second free ends (100, 200). The arm member (402) being configured to be moved between the catch position and the release position such that the hook element (404) and the catch element (412) are engaged in the catch position thereby inserting the hook element (404) into the catch element (412) to mechanically releasably secure the first and second free ends (100, 200) together in the connected condition.

According to an embodiment of the present invention, the safety catch is configured to be positioned perpendicular to the longitudinal axis of the jewellery article. However, the safety catch can be positioned along the longitudinal axis or at any inclined angle to the longitudinal axis depending upon the specific requirements.

According to a preferred embodiment of the present invention, the first and the second free ends (100, 200) of the jewellery article have a slot (406) in the bottom surface (104, 204) in the direction perpendicular to the longitudinal axis of the jewellery article to accommodate the arm member (402). The arm member (402) is configured to be positioned in the slot (406) and flush with the bottom surface (104, 204) of the first and second free ends (100, 200).

According to an embodiment of the present invention the magnetically attractive surfaces are formed on the top surface (102, 202) of first and second free ends (100, 200). The corresponding projection (302) can be defined on the first magnetically attractive surface and the recess (304) can be defined on the second magnetically attractive surface to provide top-down alignment of the first free end (100) and second free end (200) of the jewellery article. Such an arrangement of the free ends (100, 200) of jewellery article is shown in FIGS. 9-12.

According to an embodiment of the present invention, in the jewellery article at least one of the first top surface (102), the first bottom surface (104), the first left side surface (106), the first right side surface (108), the first end surface (110), the second top surface (202), the second bottom surface (204), the second left side surface (206), the second right side surface (208), and the second end surface (210) has a design feature (500).

According to a preferred embodiment of the present invention, in the jewellery article the first top surface (102) and the second top surface (202) has design feature (500), and the first bottom surface (104) and the second bottom surface (204) is plane.

According to an embodiment of the present invention in the jewellery article the design feature (500) is any ornamental design. A person skilled in the art would appreciate that ornamental design is any detail added to an object, interior or architectural structure which serves no other purpose than to make it more interesting, arresting or beautiful to viewer.

The jewellery article according to the present invention comprises at least an identification mark (600) on at least one of the first and second free ends (100, 200) to facilitate identification of the first and the second free ends to a wearer of the jewellery article. The identification mark (600) can be made of different material than jewellery article. The mark can made be of precious stones, such as diamonds, rubies or emeralds, or other ornamental materials such as glass crystals, serves both as an identification marker and an aesthetic enhancement of the jewellery article. In a preferred embodiment the identification mark can be a blue sapphire mounted at one end of the jewellery article, serves as both an identification marker and an aesthetic enhancement. Identification marker helps wearers easily distinguish which side of the jewellery article to wear, which is essential for securing correctly and creates a seamless appearance and features a distinctive blue sapphire for an enhanced look.

The jewellery article according to the present invention can be a bracelet, a necklace, a chain, neckband, or an anklet. It is understood, however, that the material of construction of jewellery article can vary as per the intended use and can be made of ornamental and precious materials such as gold, silver or platinum.

The jewellery article according to the present invention can be used as a stylish and functional accessory, suitable for everyday wear and can be used in various settings, from casual to formal occasions. The jewellery article having magnets is believed to have potential health benefits, enhancing blood circulation, which may lead to improved oxygen and nutrient supply to the body's tissues.

The jewellery article according to the present invention provides security and eliminates the clasp built into jewellery items, such as necklaces and bracelets by the manufacturer. The jewellery article of the present invention provides a smooth and seamless appearance by integrating the design with the locking mechanism, ensuring the locking mechanism remains hidden from view, preserving the article's elegant appearance. Further, the jewellery article simplifies the process of putting on and taking off, making it easy for individuals to wear by themselves enhancing the convenience of the wearer.

According to an embodiment of the present invention, to wear jewellery article for example an article kind of a tennis bracelet, in the first step wearer places the first end having side with the recess onto his/her wrist. In the next step, the wearer slowly rotates the bracelet around the wrist so that the side with the sapphire faces outward. In the further step, as the wearer brings the second end of the bracelet close to the first end, the first and second magnetically attractive surfaces attract and attach to each other. The protrusion and recess of the aligning mechanism ensures the first and second magnetically attractive surfaces are in connected condition. In the final step, the safety catch of the second locking mechanism moves to the catch position such that the hook element and the catch element are engaged to mechanically releasably secure the first and second free ends together in the connected condition of the aligned first and second magnetically attractive surfaces.

The invention of the present invention achieves the following requirements: aesthetics, solidity, security, ease of use allowing the object to be closed and opened in particular with one hand, or else by people lacking dexterity.

Although the invention has been shown and described with respect to certain preferred embodiment, it is obvious that equivalent alterations and modifications will occur to other skilled in the art upon the reading and understanding of the description.

The foregoing description of the invention has been set merely to illustrate the invention and is not intended to be limiting. Since modifications of the disclosed embodiments incorporating the substance of the invention may occur to person skilled in the art, the invention should be construed to include everything within the scope of the invention.

It is understood that the above description is intended to be illustrative, and not restrictive. It is intended to cover all alternatives, modifications and equivalents as may be included within the spirit and scope of the invention as defined in the appended claims. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein," respectively.

I claim:

1. A jewellery article, comprising:

a first locking arrangement, the first locking arrangement formed by connecting a first free end of the jewellery article to a second free end of the jewellery article between a separated condition and a connected condition, the first free end having a first magnetically attractive surface formed by at least one magnet positioned on a lateral surface thereof, the second free end having a second magnetically attractive surface formed by at least one magnet positioned on a lateral surface thereof, the first and second magnetically attractive surfaces magnetically attract to the other in the connected condition when the lateral surfaces of the first and second free ends are parallel to each other, the first and second free ends configured to be moved into the separated condition in response to a pulling force applied thereby breaking the magnetic attraction between the first and second magnetically attractive surfaces;

an alignment mechanism, the alignment mechanism formed by engaging a projection defined on the lateral surface of the first magnetically attractive surface with a recess defined on the lateral surface of the second magnetically attractive surface thereby facilitating precise alignment of the first and second magnetically attractive surfaces, said projection configured to be positioned within said recess such that said first and second free ends are aligned thereby preventing twisting of the first and second free ends about a longitudinal axis thereof; and a second locking arrangement facilitated by a safety catch, the safety catch pivotably connected to one of the first or second free ends, the safety catch having an arm member, the arm member having a hook element connected thereto, the first and second free ends have a slot in a bottom surface in the direction perpendicular to the longitudinal axis of the jewellery article to accommodate the arm member, the safety catch having a catch element being located within the other of the first or second free ends, the arm member configured to be moved between a catch position and a release position such that the hook element and the catch element are engaged in the catch position thereby inserting the hook element into the catch element to mechanically releasably secure the first and second free ends together in the connected condition of the aligned first and second magnetically attractive surfaces.

2. The jewellery article according to claim 1, wherein the safety catch is configured to be positioned perpendicular to the longitudinal axis of the jewellery article.

3. The jewellery article according to claim 1, wherein the slot is configured to receive the arm member such that the arm member flush with the bottom surface of the first and second free ends.

4. The jewellery article according to claim 1, wherein one of the first and second free ends has at least an identification mark adapted to facilitate identification of between the first and the second free ends to a wearer of the jewellery article.

5. A jewellery article, comprising:

a first locking mechanism, the first locking arrangement formed by connecting a first free end of the jewellery article to a second free end of the jewellery article between a separated condition and a connected condition, the first free end having a first top surface, a first bottom surface, a first left side surface, a first right side surface, and a first end surface, the first end securing a first magnet, the first magnet being positioned at and flush with one of the left or right side surface of the first free end and forming a first magnetically attractive surface therein, and the first magnetically attractive surface is perpendicular to the plane of the first top surface and the first bottom surface;

the second end including a second top surface, a second bottom surface, a second left side surface, a second right side surface, and a second end surface, the second end securing a second magnet, the second magnet being positioned at and flush with other of the left or right side surface of the second end and forming a second magnetically attractive surface therein, and the second magnetically attractive surface is perpendicular to the plane of the second top surface and the second bottom surface, such that the first magnetically attractive surface being opposite polarity of the second magnetically attractive surface and the first and second magnetically attractive surfaces magnetically attract to the other in the connected condition when the side surfaces of the first and second free ends are parallel to each other, the first and second free ends configured to be moved into the separated condition in response to a pulling force applied thereby breaking the magnetic attraction between the first and second magnetically attractive surfaces;

an alignment mechanism, the alignment mechanism to align the magnetically attractive surfaces of the first end and the second end precisely, the alignment mechanism comprising a projection defined on the first magnetically attractive surface and a recess defined on the second magnetically attractive surface, said projection being complimentary shaped and arranged to be positioned within said recess such that said first end and second end are aligned to prevent twisting of the first and second free ends about the longitudinal axis thereof; and a second locking arrangement facilitated by a safety catch, the safety catch connected to one of the first or the second free ends in one of a pivoted or hinged manner, the safety catch includes an arm member having a hook element movable between a catch position and a release position, the first and second free ends have a slot in a bottom surface in the direction perpendicular to the longitudinal axis of the jewellery article to accommodate the arm member, the catch element being located within the other of the first or the second free ends, the arm member configured to be moved between the catch position and the release position such that the hook element and the catch element are engaged in the catch position thereby inserting the hook element into the catch element to mechanically releasably secure the first and second free ends together in the connected condition of the aligned first and second magnetically attractive surfaces.

6. The jewellery article according to claim 5, wherein at least one of the first top surface, the first bottom surface, the first left side surface, the first right side surface, the first end surface, the second top surface, the second bottom surface, the second left side surface, the second right side surface, and the second end surface has a design feature.

7. The jewellery article according to claim 6, wherein the design feature is on the first top surface and the second top surface.

8. The jewellery article according to claim 6, wherein the design feature is any ornamental design.

9. The jewellery article according to claim 5, wherein the safety catch is configured to be positioned perpendicular to the longitudinal axis of the jewellery article.

10. The jewellery article according to claim 5, wherein the slot is configured to receive the arm member such that the arm member flush with the bottom surface of the first and second free ends.

11. The jewellery article according to claim 5, wherein one of the first and second free ends has at least an identification mark adapted to facilitate identification of between the first and the second free ends to a wearer of the jewellery article.

* * * * *